US006302507B1

(12) United States Patent
Prakash et al.

(10) Patent No.: US 6,302,507 B1
(45) Date of Patent: Oct. 16, 2001

(54) METHOD FOR CONTROLLING THE OVER-ENERGY APPLIED TO AN INKJET PRINT CARTRIDGE USING DYNAMIC PULSE WIDTH ADJUSTMENT BASED ON PRINTHEAD TEMPERATURE

(75) Inventors: Satya Prakash, Poway; Ronald A Askeland, San Diego; Clayton L Holstun, San Marcos; Noah C. Lassar, San Diego, all of CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/416,800

(22) Filed: Oct. 13, 1999

(51) Int. Cl.[7] ..... B41J 2/05
(52) U.S. Cl. ..... 347/14; 347/19
(58) Field of Search ..... 347/5, 9, 10, 11, 347/14, 19, 57; 372/34

(56) References Cited

U.S. PATENT DOCUMENTS 5,075,690 * 12/1991 Kneezel ..... 347/17
5,418,558 5/1995 Hock et al. ..... 347/14
5,428,376 6/1995 Wade et al. ..... 347/14
5,526,027 * 6/1996 Wade et al. ..... 347/14
5,682,185 10/1997 Wade et al. ..... 347/19
5,745,130 * 4/1998 Becerra et al. ..... 347/14
5,966,394 * 10/1999 Spurr et al. ..... 372/34

* cited by examiner

*Primary Examiner*—Ana T. N. Vo
(74) *Attorney, Agent, or Firm*—Dennis G. Stenstrom

(57) ABSTRACT

A temperature control system for an inkjet printhead assembly includes a printhead assembly having ink ejection elements energizable by an electrical pulse having an amplitude and pulse width, a sensor coupled to the printhead assembly for generating a signal representative of a printhead temperature. A controller reads a nominal operating pulse width, pulse width calibration data and the signal from the sensor. The controller calculates an adjusted pulse width using the nominal operating pulse width, the pulse width calibration data and the signal from the sensor. The controller uses the adjusted pulse width to control the printhead temperature.

22 Claims, 8 Drawing Sheets

METHOD FOR CONTROLLING THE OVER-ENERGY APPLIED TO AN INKJET PRINT CARTRIDGE USING DYNAMIC PULSE WIDTH ADJUSTMENT BASED ON PRINTHEAD TEMPERATURE

CROSS-REFERENCE TO RELATED APPLICATIONS

This application is related to U.S. patent application Ser. No. 09/253,417, filed Feb. 19, 1999, entitled "A System and Method for Controlling Thermal Characteristics of an Inkjet Printhead;" U.S. patent application Ser. No. 09/183,949, filed Oct. 31, 1998, entitled "Varying the Operating Energy Applied to an Inkjet Print Cartridge Based upon the Operating Conditions;" U.S. patent application Ser. No. 09/071,138, filed Apr. 30, 1998, entitled "Energy Control Method for an Inkjet Print Cartridge;" U.S. patent application Ser. No. 08/958,951, filed Oct. 28, 1997, entitled "Thermal Ink Jet Print Head and Printer Energy Control Apparatus and Method," U.S. Pat. No. 5,418,558, entitled "Determining the Operating Energy of a Thermal Ink Jet Printhead Using an Onboard Thermal Sense Resistor;" U.S. Pat. No. 5,428,376, entitled "Thermal Turn on Energy Test for an Inkjet Printer;" U.S. Pat. No. 5,682,185 entitled "Energy Management Scheme for an Ink Jet Printer;" U.S. patent application Ser. No. 09/016,478, filed Jan. 30, 1998, entitled "Hybrid Multi-Drop/Multi-Pass Printing System;" U.S. patent application Ser. No. 08/962,031, filed Oct. 31, 1997, entitled "Ink Delivery System for High Speed Printing" and U.S. patent application Ser. No. 09/253,411, filed Feb. 19, 1999, entitled "A High Performance Printing System and Protocol." The foregoing commonly assigned patents and patent applications are herein incorporated by reference.

FIELD OF THE INVENTION

This invention relates to thermal inkjet printers, and more particularly to the control of the printhead firing energy.

BACKGROUND OF THE INVENTION

Thermal inkjet hardcopy devices such as printers, graphics plotters, facsimile machines and copiers have gained wide acceptance. These hardcopy devices are described by W. J. Lloyd and H. T. Taub in "Ink Jet Devices," Chapter 13 of *Output Hardcopy Devices* (Ed. R. C. Durbeck and S. Sherr, San Diego: Academic Press, 1988). The basics of this technology are further disclosed in various articles in several editions of the *Hewlett-Packard Journal* [Vol. 36, No. 5 (May 1985), Vol. 39, No. 4 (August 1988), Vol. 39, No. 5 (Oct. 1988), Vol. 43, No. 4 (August 1992), Vol. 43, No. 6 (December 1992) and Vol. 45, No. 1 (February 1994)], incorporated herein by reference. Inkjet hardcopy devices produce high quality print, are compact and portable, and print quickly and quietly because only ink strikes the paper.

An inkjet printer forms a printed image by printing a pattern of individual dots at particular locations of an array defined for the printing medium. The locations are conveniently visualized as being small dots in a rectilinear array. The locations are sometimes "dot locations", "dot positions", or pixels". Thus, the printing operation can be viewed as the filling of a pattern of dot locations with dots of ink.

Inkjet hardcopy devices print dots by ejecting very small drops of ink onto the print medium and typically include a movable carriage that supports one or more printheads each having ink ejecting ink ejection elements. The carriage traverses over the surface of the print medium, and the ink ejection elements are controlled to eject drops of ink at appropriate times pursuant to command of a microcomputer or other controller, wherein the timing of the application of the ink drops is intended to correspond to the pattern of pixels of the image being printed.

The typical inkjet printhead (i.e., the silicon substrate, structures built on the substrate, and connections to the substrate) uses liquid ink (i.e., dissolved colorants or pigments dispersed in a solvent). It has an array of precisely formed orifices or nozzles attached to a printhead substrate that incorporates an array of ink ejection chambers which receive liquid ink from the ink reservoir. Each chamber is located opposite the nozzle so ink can collect between it and the nozzle and has a firing resistor located in the chamber. The ejection of ink droplets is typically under the control of a microprocessor, the signals of which are conveyed by electrical traces to the resistor elements. When electric printing pulses heat the inkjet firing chamber resistor, a small portion of the ink next to it vaporizes and ejects a drop of ink from the printhead. Properly arranged nozzles form a dot matrix pattern. Properly sequencing the operation of each nozzle causes characters or images to be printed upon the paper as the printhead moves past the paper.

In an inkjet printhead the ink is fed from an ink reservoir integral to the printhead or an "off-axis" ink reservoir which feeds ink to the printhead via tubes connecting the printhead and reservoir. Ink is then fed to the various vaporization chambers either through an elongated hole formed in the center of the bottom of the substrate, "center feed", or around the outer edges of the substrate, "edge feed."

The ink cartridge containing the ink ejection elements is moved repeatedly across the width of the medium to be printed upon. At each of a designated number of increments of this movement across the medium, each of the resistors is caused either to eject ink or to refrain from ejecting ink according to the program output of the controlling microprocessor. Each completed movement across the medium can print a swath approximately as wide as the number of nozzles arranged in a column of the ink cartridge multiplied times the distance between nozzle centers. After each such completed movement or swath the medium is moved forward the width of the swath, and the ink cartridge begins the next swath. By proper selection and timing of the signals, the desired print is obtained on the medium.

Thermal inkjet printheads require an electrical drive pulse from a printer in order to eject a drop of ink. The voltage amplitude, shape and width of the pulse affect the printhead's performance. It is desirable to operate the printhead using pulses that deliver a specified amount of energy. The energy delivered depends on the pulse characteristics (width, amplitude, shape), as well as the resistance of the printhead.

A thermal inkjet printhead requires a certain minimum energy to fire ink drops of the proper volume (herein called the turn-on energy). Turn-on energy can be different for different printhead designs, and in fact varies among different samples of a given printhead design as a result of manufacturing tolerances. In an integrated driver type printhead, the total resistance consists of the heater resistance in series with a field effect transistor and other trace resistances, each of which has an associated manufacturing tolerance. These tolerances add to the uncertainty in knowing how much energy is being delivered to any given printhead. Therefore, it is necessary to deliver more energy to the average printhead than is required to fire it (called "over-energy") in order to allow for this uncertainty As a result, thermal inkjet printers are configured to provide a fixed ink firing energy that is greater than the expected lowest turn-on energy for the printhead cartridges it can accommodate. A consideration with utilizing a fixed ink firing energy is that firing energies excessively greater than the actual turn-on energy of a particular printhead cartridge result in a shorter operating lifetime for the heater resistors and degraded print quality.

The energy applied to a firing resistor affects performance, durability and efficiency. It is well known that the firing energy must be above a certain firing threshold to cause a vapor bubble to nucleate. Above this firing threshold is a transitional range where increasing the firing energy increases the volume of ink expelled. Above this transitional range, there is a higher optimal range where drop volumes do not increase with increasing firing energy. In this optimal range above the optimal firing threshold drop volumes are stable even with moderate firing energy variations. Since, variations in drop volume cause disuniformities in printed output, it is in this optimal range that printing ideally takes place. As energy levels increase in this optimal range, uniformity is not compromised, but energy is wasted and the printhead is prematurely aged due to excessive heating and ink residue build-up.

In existing printheads having a dedicated connection for each firing resistor, or for a group of resistors called a primitive, a one time calibration of each connection by either the printer or production circuitry external to the print cartridge also compensates for any parasitic resistance or impedance in the unique path leading to each resistor. Printheads may be characterized at production to set these operating parameters. The printer then uses these operating parameters.

However, in new smart drive printheads wherein each firing resistor or each primitive does not have a dedicated connection, there may be variations due to other factors. A large number of resistors is powered by a single voltage line that receives power via an electrical contact pad between the printer electronics and the removable print cartridge. Consequently, as the data load being printed changes, the current draw through the line and the voltage as measured at the firing resistor may be undesirably varied. For instance, when many or all resistors are fired simultaneously, the print cartridge voltage may be depressed by parasitic effects, giving a lower firing voltage than when only one or a few resistors are fired.

In typical inkjet printers, as each droplet of ink is ejected from the printhead, some of the heat used to vaporize the ink driving the droplet is retained within the printhead and for high flow rates, conduction can heat the ink near the substrate. These actions can overheat the printhead, which can degrade print quality, cause the ink ejection elements to misfire, or can cause the printhead to stop firing completely. Printhead overheating compromises the inkjet printing process and limits high throughput printing. In addition, current inkjet printheads do not have the ability to make their own firing and timing decisions because they are controlled by remote devices. Consequently, it is difficult to efficiently control important thermal and energy aspects of the printhead.

Therefore, what is needed is a new printing system and protocol that utilizes a printhead with an integrated distributive processor and ink driver head for providing efficient thermal and energy control of the printhead.

SUMMARY OF THE INVENTION

A temperature control system for an inkjet printhead assembly, including a printhead assembly having ink ejection elements energizable by an electrical pulse having an amplitude and pulse width, a sensor coupled to the printhead assembly for generating a signal representative of the printhead temperature. A controller for reading a nominal operating pulse width, pulse width calibration data and the signal from the sensor. The controller calculates an adjusted pulse width using the nominal operating pulse width, the pulse width calibration data and the signal from the sensor. The controller uses the adjusted pulse width to control printhead temperature.

A method of controlling the temperature of an inkjet printhead including providing a printhead assembly having ink ejection elements energizable by an electrical pulse having an amplitude and pulse width, reading a nominal printhead operating temperature, a nominal operating pulse width and pulse width calibration data, obtaining a current printhead operating temperature using a sensor on the printhead, determining a pulse width adjustment factor based on the pulse width calibration data and the measured temperature of the printhead, calculating an adjusted operating pulse width based on the pulse width adjustment factor and the nominal operating pulse width; and applying the adjusted operating pulse width to the printhead to control printhead temperature.

BRIEF DESCRIPTION OF THE DRAWINGS

The present invention can be further understood by reference to the following description and attached drawings that illustrate the preferred embodiment. Other features and advantages will be apparent from the following detailed description of the preferred embodiment, taken in conjunction with the accompanying drawings, which illustrate, by way of example, the principles of the invention.

DETAILED DESCRIPTION OF A PREFERRED EMBODIMENT

In the following description of the invention, reference is made to the accompanying drawings, which form a part hereof, and in which is shown by way of illustration a specific example in which the invention may be practiced. It is to be understood that other embodiments may be utilized and structural changes may be made without departing from the scope of the present invention.

Figure 1A:
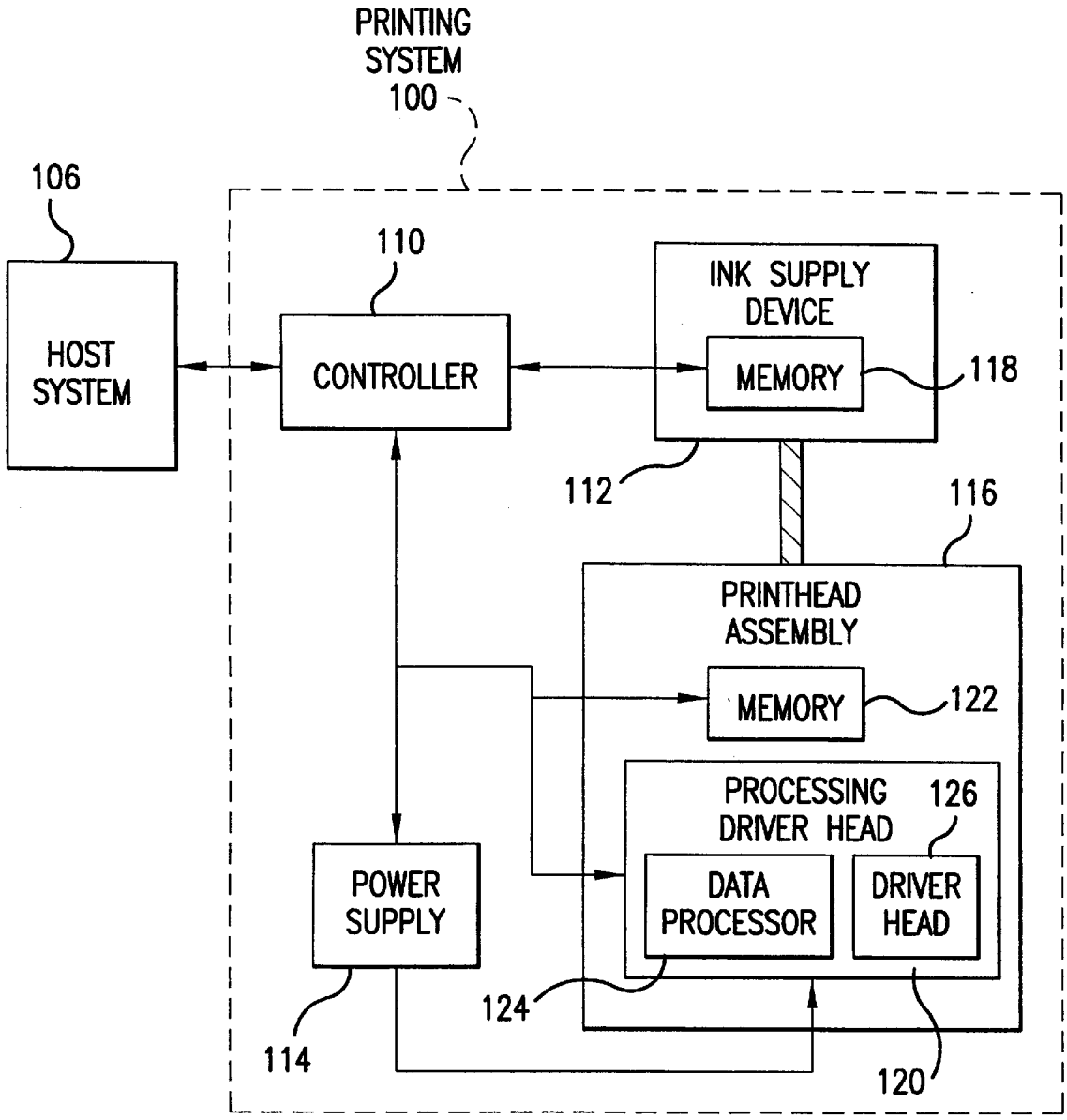
FIG. 1A shows a block diagram of an overall printing system incorporating the present invention.

FIG. 1A shows a block diagram of an overall printing system incorporating the present invention. The printing system 100 can be used for printing a material, such as ink on a print media, which can be paper. The printing system 100 is electrically coupled to a host system 106, which can be a computer or microprocessor for producing print data. The printing system 100 includes a controller 110 coupled to an ink supply device 112, a power supply 114 and a printhead assembly 116. The ink supply device 112 includes an ink supply memory device 118 and is fluidically coupled to the printhead assembly 116 for selectively providing ink to the printhead assembly 116. The printhead assembly 116 includes a processing driver head 120 and a printhead memory device 122. The processing driver head 120 is comprised of a data processor 124, such as a distributive processor, and a driver head 126, such as an array of inkjet ink ejection elements or drop generators 416.

During operation of the printing system 100, the power supply 114 provides a controlled voltage to the controller 110 and the processing driver head 120. Also, the controller 110 receives the print data from the host system and processes the data into printer control information and image data. The processed data, image data and other static and dynamically generated data (discussed in detail below), is exchanged with the ink supply device 112 and the printhead assembly 116 for efficiently controlling the printing system.

The ink supply memory device 118 can store various ink supply specific data, including ink identification data, ink characterization data, ink usage data and the like. The ink supply data can be written and stored in the ink supply memory device 118 at the time the ink supply device 112 is manufactured or during operation of the printing system 100. Similarly, the printhead memory device 122 can store various printhead specific data, including printhead identification data, warranty data, printhead characterization data, printhead usage data, etc. This data can be written and stored in the printhead memory device 122 at the time the printhead assembly 116 is manufactured or during operation of the printing system 100.

Although the data processor 124 can communicate with memory devices 118, 122, the data processor 124 preferably primarily communicates with the controller 110 in a bi-directional manner. The bi-directional communication enables the data processor 124 to dynamically formulate and perform its own firing and timing operations based on sensed and given operating information for regulating the temperature of, and the energy delivered to the processing driver head 120. These formulated decisions are preferably based on, among other things, sensed printhead temperatures, sensed amount of power supplied, real time tests, and preprogrammed known optimal operating ranges, such as temperature and energy ranges. As a result, the data processor 124 enables efficient operation of the processing driver head 120 and produces droplets of ink that are printed on a print media to form a desired pattern for generating enhanced printed outputs.

Figure 1B:
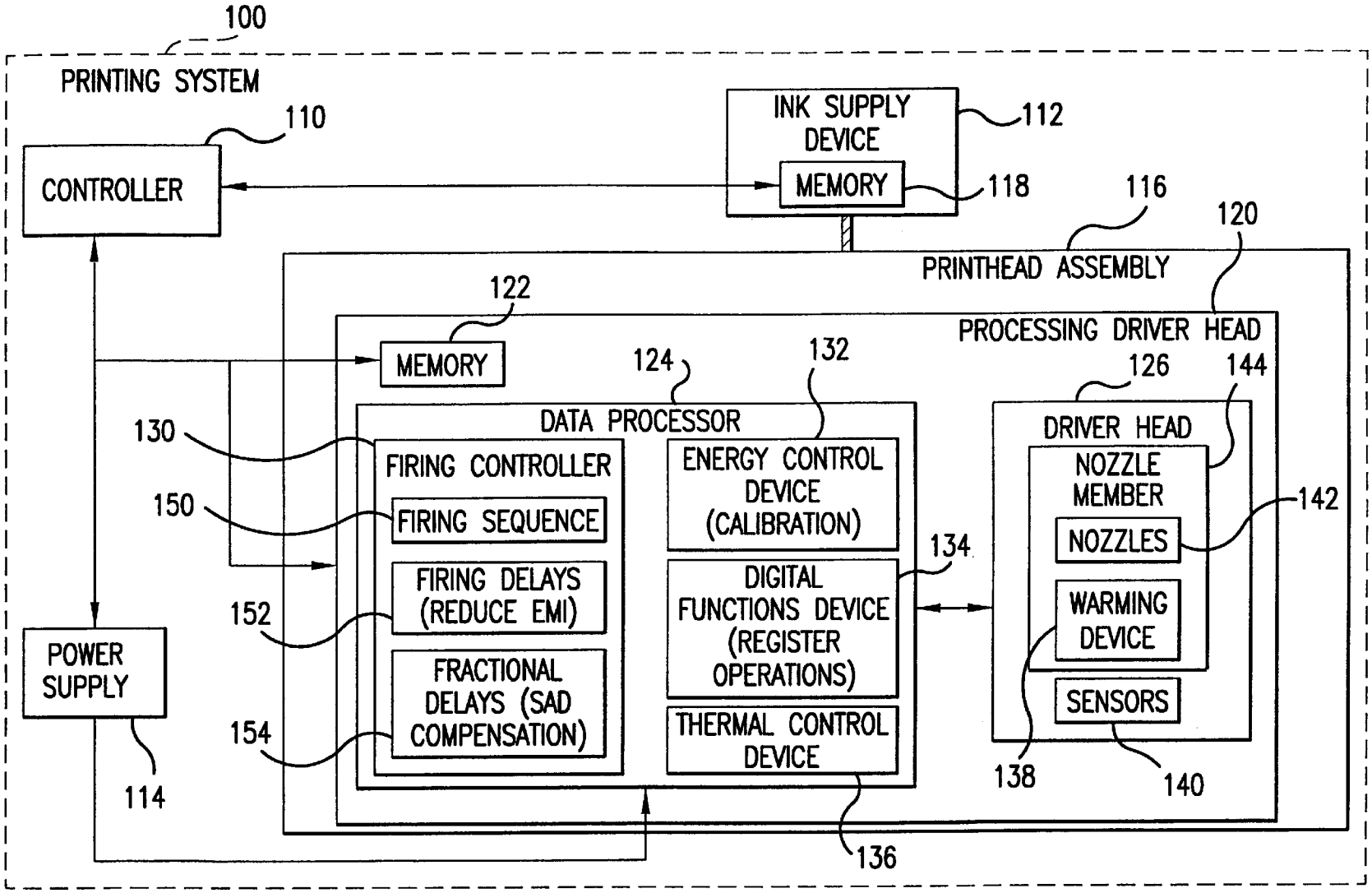
FIG 1B shows a block diagram of an overall printing system incorporating a preferred embodiment of the present invention.

FIG. 1B shows a block diagram of an overall printing system 100 incorporating the preferred embodiment of the present invention. The data processor 124 of the present invention further includes a firing controller 130, an energy control device 132, a digital function device 134 and a thermal control device 136. The driver head 126 further includes a warming device 138 and sensors 140. Although the firing controller 130, energy control device 132, digital function device 134, thermal control device 136, warming device 138 and sensors 140 could be sub-components of other components, such as controller 110, in a preferred embodiment they are respective sub-components of the data processor 124 and the driver head 126, as shown FIG. 1B.

The firing controller 130 communicates with the controller 110 and the driver head 126 (in another embodiment it also communicates with the printhead assembly memory device 122) for regulating the firing of ink ejection elements 416 of associated nozzles 142 of nozzle member 144. The firing controller 130 includes a firing sequence sub-controller 150 for selectively controlling the sequence of fire pulses, a firing delay sub-controller 152 for reducing electromagnetic interference in the processing driver head 120 and a fractional delay sub-controller 154 for compensating for scan axis directionality errors of the driver head 126.

The energy control device 132 communicates with the controller 110 and the sensors 140 of the driver head 126 for regulating the energy delivered to the driver head 126. Similarly, the thermal control device 136 communicates with the controller 110 and the sensors 140 and the warming device 138 of the driver head 126 for regulating the thermal characteristics of the driver head 126. The thermal control device 136 accomplishes this by activating the warming device 138 when the sensors 140 indicate that the driver head 126 is below a threshold temperature. In another embodiment, energy and thermal control devices 132, 136 also communicate with the printhead assembly memory device 122. The digital functions device 134 manages internal register operations and processing tasks of the data processor 124.

Figure 2:
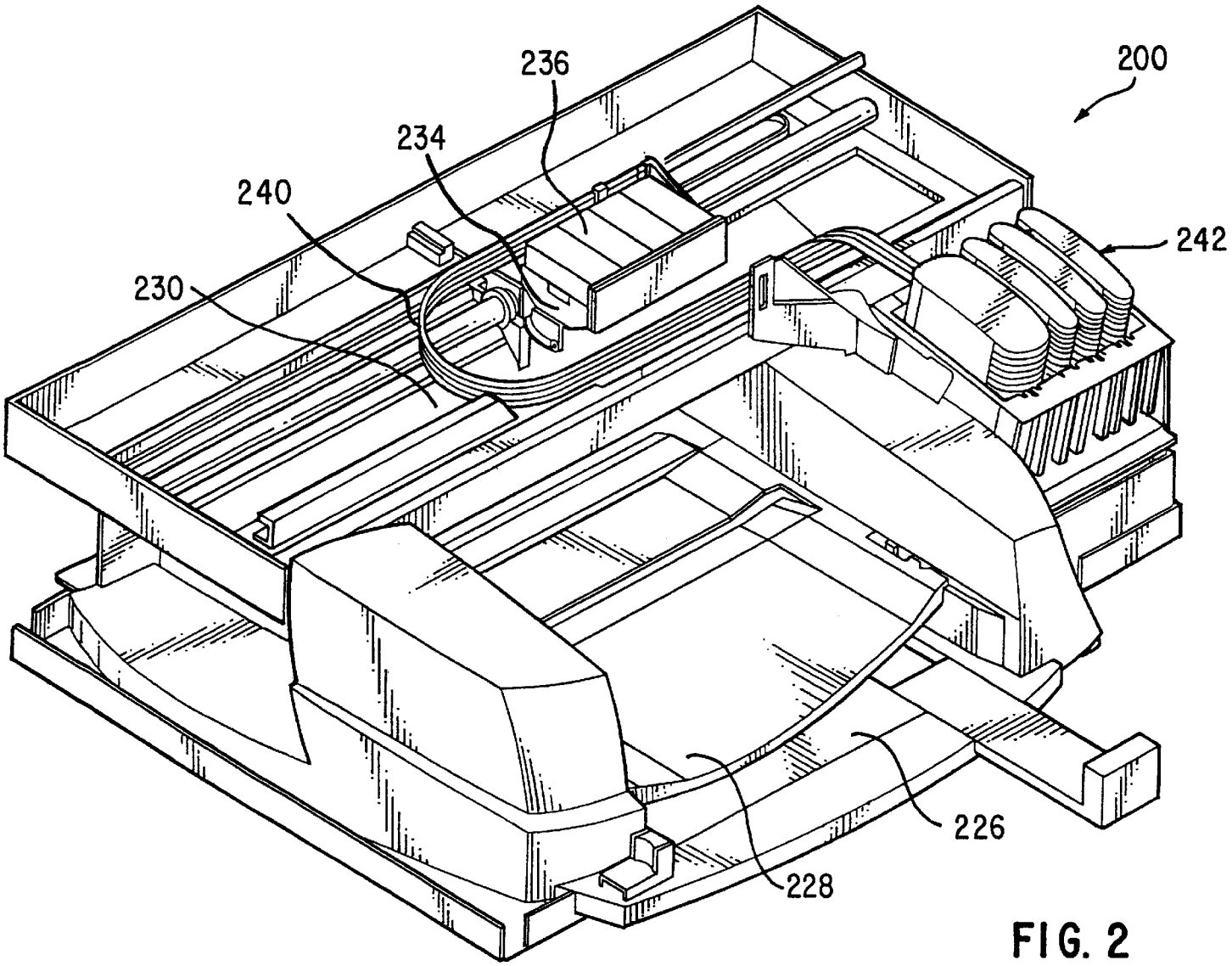
FIG. 2 is an exemplary printer that incorporates the invention and is shown for illustrative purposes only.

FIG. 2 is an exemplary high-speed printer that incorporates the invention and is shown for illustrative purposes only. Generally, printer 200 can incorporate the printing system 100 of FIG. 1A and further include a tray 222 for holding print media. When a printing operation is initiated, print media, such as paper, is fed into printer 200 from tray 222 preferably using a sheet feeder 226. The sheet then brought around in a U direction and travels in an opposite direction toward output tray 228. Other paper paths, such as a straight paper path, can also be used. The sheet is stopped in a print zone 230, and a scanning carriage 234, supporting one or more printhead assemblies 236 (an example of printhead assembly 116 of FIG. 1), is then scanned across the sheet for printing a swath of ink thereon. After a single scan or multiple scans, the sheet is then incrementally shifted using, for example, a stepper motor and feed rollers to a next position within the print zone 230. Carriage 234 again scans across the sheet for printing a next swath of ink. The process repeats until the entire sheet has been printed, at which point it is ejected into output tray 228.

The present invention is equally applicable to alternative printing systems (not shown) that utilize alternative media and/or printhead moving mechanisms, such as those incorporating grit wheel, roll feed or drum technology to support and move the print media relative to the printhead assemblies 236. With a grit wheel design, a grit wheel and pinch roller move the media back and forth along one axis while a carriage carrying one or more printhead assemblies scans past the media along an orthogonal axis. With a drum printer design, the media is mounted to a rotating drum that is rotated along one axis while a carriage carrying one or more printhead assemblies scans past the media along an orthogonal axis. In either the drum or grit wheel designs, the scanning is typically not done in a back and forth manner as is the case for the system depicted in FIG. 2.

The print assemblies 236 can be removably mounted or permanently mounted to the scanning carriage 234. Also, the printhead assemblies 236 can have self-contained ink reservoirs (for example, the reservoir can be located within printhead body 304 of FIG. 3) as the ink supply 112 of FIG. 1. The self-contained ink reservoirs can be refilled with ink for reusing the print assemblies 236. Alternatively, each print cartridge 236 can be fluidically coupled, via a flexible conduit 240, to one of a plurality of fixed or removable ink containers 242 acting as the ink supply 112 of FIG. 1. As a further alternative, the ink supplies 112 can be one or more ink containers separate or separable from printhead assemblies 116 and removably mountable to carriage 234.

Figure 3:
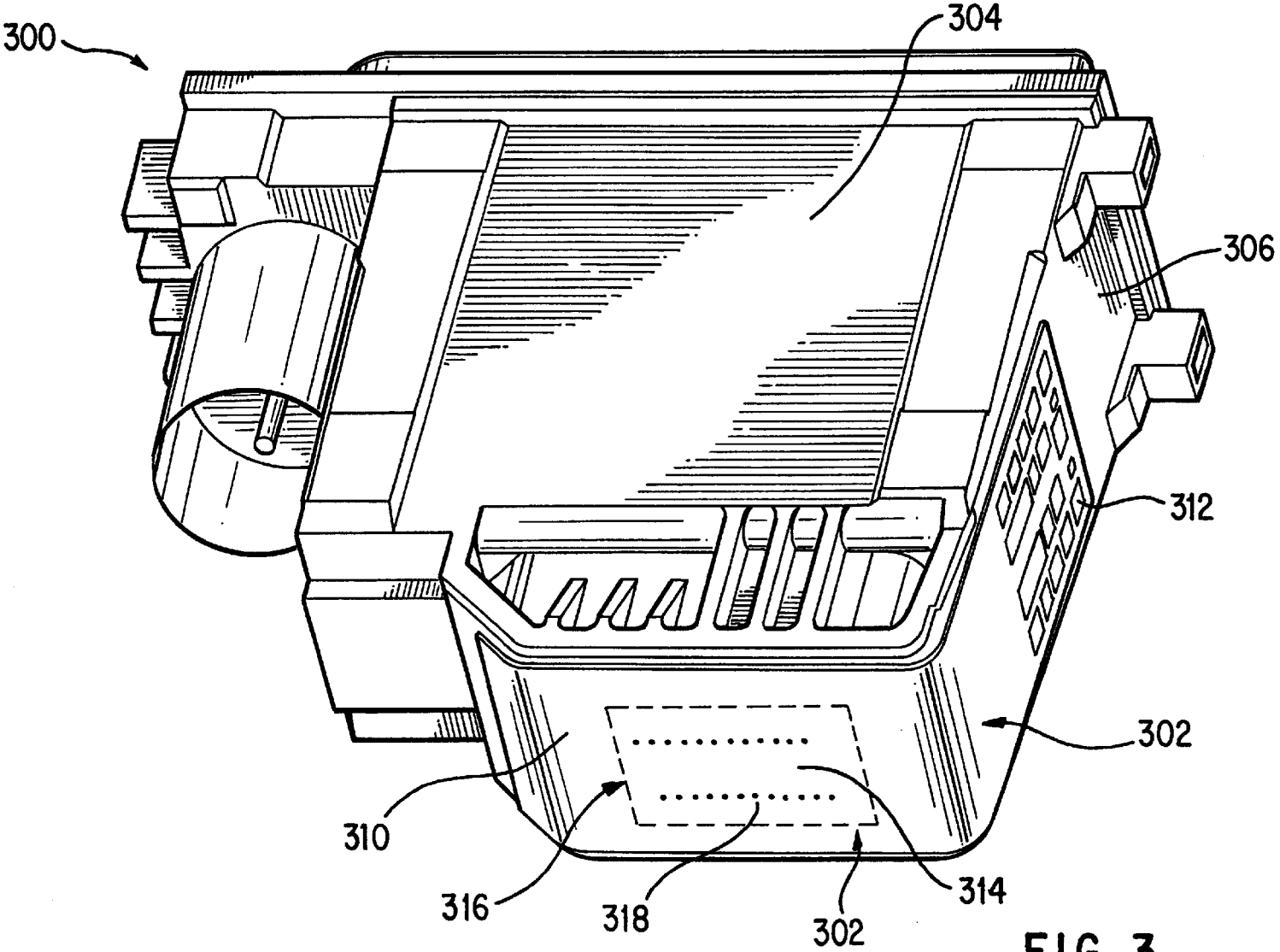
FIG 3 shows for illustrative purposes only a perspective view of an exemplary print cartridge incorporating the present invention.

FIG. 3 shows for illustrative purposes only a perspective view of an exemplary printhead assembly 300 (an example of the printhead assembly 116 of FIG. 1) incorporating the present invention. A detailed description of the present invention follows with reference to a typical printhead assembly used with a typical printer, such as printer 200 of FIG. 2. However, the present invention can be incorporated in any printhead and printer configuration. Referring to FIGS. 1A and 2 along with FIG. 3, the printhead assembly 300 is comprised of a thermal inkjet head assembly 302, a printhead body 304 and a printhead memory device 306, which is an example of memory device 122 and discussed in detail in FIG. 5 below. The thermal head assembly 302 can be a flexible material commonly referred to as a Tape Automated Bonding (TAB) assembly and can contain a processing driver head 310 (an example of processing driver head 120 of FIG. 1) and interconnect contact pads 312. The interconnect contact pads 312 are suitably secured to the print cartridge 300, for example, by an adhesive material. The contact pads 312 align with and electrically contact electrodes (not shown) on carriage 234 of FIG. 2.

The processing driver head 310 comprises a distributive processor 314 (an example of the data processor 124 of FIG: 1) preferably integrated with a nozzle member 316 (an example of driver head 126 of FIG. 1). The nozzle member 316 preferably contains plural orifices or nozzles 318, which can be created by, for example, laser ablation, for creating ink drop generation on a print media.

The distributive processor 314 preferably includes digital circuitry and communicates via electrical signals with the controller 110, nozzle member 316 and various analog devices, such as temperature sensors which can be located on the nozzle member 316. The distributive processor 314 communicates with the controller in a bi-directional manner over a bi-directional data line. The controller sends commands to the distributive processor and receives and processes signals from the distributive processor.

The distributive processor 314 makes decisions and actions based on its input signals. For example, controlling firing, timing, thermal and energy aspects and pulse width decisions of the printhead assembly 300 and nozzle member 316 timing can be made by the distributive processor. These decisions may alternatively may be made by the controller 110 of the printing system. The distributive processor 314 also receives sensor signals from sensors 140 located on the driver head 310. The sensors 140 can also be connected to the controller 110 via a direct connection or through the printer's memory device for continuously updating the controller.

Figure 4:
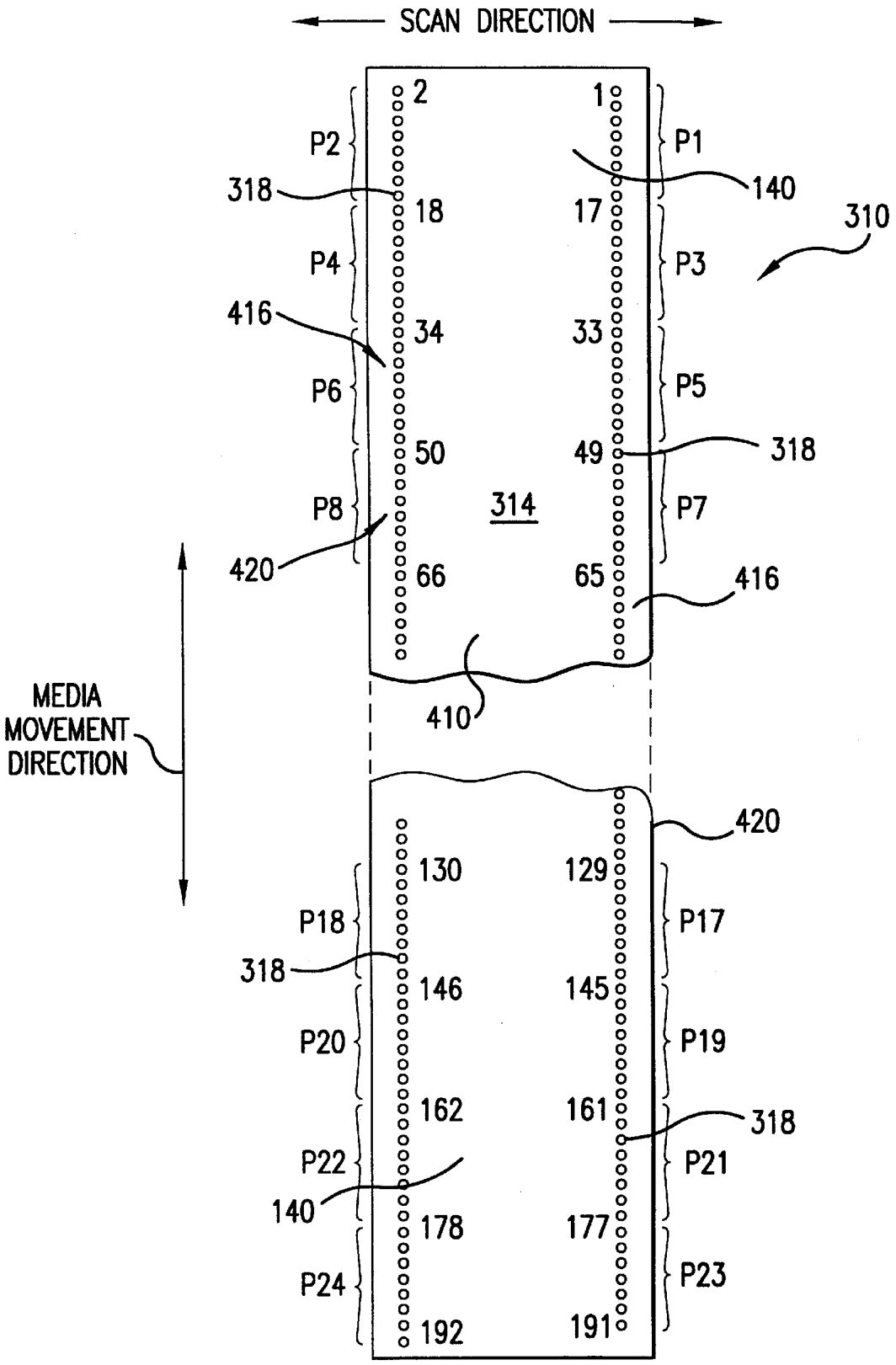
FIG. 4 is a detailed view of the integrated processing driver head of FIG. 3 showing the distributive processor and the resistor and primitive layout of the driver head of the printhead assembly.

FIG. 4 is a detailed view of an exemplary integrated processing driver head of FIG. 3 showing the distributive processor and the driver head of the printhead assembly. The elements of FIG. 4 are not to scale and are exaggerated for simplification. Referring to FIGS. 1–3 along with FIG. 4, as discussed above, conductors (not shown) are formed on the back of TAB head assembly 302 and terminate in contact pads 312 for contacting electrodes on carriage 234. The electrodes on carriage 234 are coupled to the controller 110 and power supply 114 for providing communication with the thermal head assembly 302. The other ends of the conductors are bonded to the processing driver head 310 via terminals or electrodes on substrate 410. The substrate 410 has ink ejection elements 416 formed thereon and electrically coupled to the conductors. The controller 110 and distributive processor 314 provide the ink ejection elements 416 with operational electrical signals.

A barrier layer (not shown) is formed on the surface of the substrate 410 to define ink ejection chambers, preferably using photo lithographic techniques, and can be a layer of photo resist or some other polymer. The ink ejection chamber (not shown) contains an ink ejection element 416 and is preferably located behind a single nozzle 318 of the nozzle member 316. A portion of the barrier layer insulates the conductive traces from the underlying substrate 410.

Each ink ejection element 416 ejects ink when selectively energized by one or more pulses applied sequentially or simultaneously to one or more of the contact pads 312. The ink ejection elements 416 may be heater resistors or piezoelectric elements. Each ink ejection element 416 is allocated to a specific group of ink ejection elements 416, hereinafter referred to as a primitive 420. The processing driver head 310 may be arranged into any number of multiple subsections with each subsection having a particular number of primitives containing a particular number of ink ejection elements 416. The nozzles 318 may be of any size, number, and pattern, and the various figures are designed to simply and clearly show the features of the invention. The relative dimensions of the various features have been greatly adjusted for the sake of clarity.

In the case of FIG. 4, the processing driver head 310 has 192 nozzles with 192 associated firing ink ejection elements 416. There are preferably 24 primitives in two columns of 12 primitives each. The primitives in each column have 8 resistors each for a total of 192 resistors. The ink ejection elements 416 on one side all have odd numbers, starting at the first resistor (R1) and continuing to the third resistor (R3), fifth resistor (R5) and so on. The ink ejection elements 416 on the other side all have even numbers, starting at the second resistor (R2) and continuing to the fourth resistor (R4), sixth resistor (R6) and so on.

In order to provide a printhead assembly where the ink ejection elements 416 are individually addressable, but with a limited number of lines between the printer 200 and print cartridge 236, the interconnections to the ink ejection elements 416 in an integrated drive printhead are multiplexed. The print driver circuitry comprises an array of primitive lines, primitive commons, and address select lines to control ink ejections elements 416. Specifying an address line and a primitive line uniquely identifies one particular ink ejection element 416. The number of ink ejection elements 416 within a primitive is equal to the number of address lines. Any combination of address lines and primitive select lines could be used, however, it is useful to minimize the number of address lines in order to minimize the time required to cycle through the address lines.

Each ink ejection element 416 is controlled by its own drive transistor which shares its control input address select with the number of ejection elements 416 in a primitive. Each ink ejection element 416 is tied to other ink ejection elements 416 by a common node primitive select. Consequently, firing a particular ink ejection element 416 requires applying a control voltage at its address select terminal and an electrical power source at its primitive select terminal. In response to print commands from the printer, each primitive is selectively energized by powering the associated primitive select interconnection. To provide uniform energy per heater ink ejection element 416 only one ink ejection element is energized at a time per primitive. However, any number of the primitive selects may be enabled concurrently. Each enabled primitive select thus delivers both power and one of the enable signals to the driver transistor. The other enable signal is an address signal provided by each address select line only one of which is active at a time. Each address select line is tied to all of the switching transistors so that all such switching devices are conductive when the interconnection is enabled. Where a primitive select interconnection and an address select line for a ink ejection element 416 are both active simultaneously, that particular heater ink ejection element 416 is energized. Only one address select line is enabled at one time. This ensures that the primitive select and group return lines supply current to at most one ink ejection element 416 at a time. Otherwise, the energy delivered to a heater ink ejection element 416 would be a function of the number of ink ejection elements 416 being energized at the same time.

Additional details regarding the architecture and control of inkjet printheads are described in U.S. patent application Ser. No. 09/253,417, filed Feb. 19, 1999, entitled "A System and Method for Controlling Thermal Characteristics of an Inkjet Printhead;" U.S. patent application Ser. No. 09/016,478, filed Jan. 30, 1998, entitled "Hybrid Multi-Drop/Multi-Pass Printing System" and U.S. patent application Ser. No. 08/962,031, filed Oct. 31, 1997, entitled "Ink Delivery System for High Speed Printing" which are herein incorporated by reference.

The processing driver head 120 is comprised of a data processor 124, such as a distributive processor 314, and a driver head 126, such as an array of inkjet ink ejection elements for ejecting ink drops. The sensors 140 can be temperature sensors for controlling the energy delivered to, and the temperature of, the printhead assembly 116.

During operation of the printing system 100, the power supply 114 provides a controlled voltage or voltages to the printer controller 110 and the processing driver head 120. The data processor 124 can communicate with the controller 110 in a bi-directional manner with serial data communications. The bi-directional communication enables the data processor 124, 314 to dynamically formulate and perform its own firing and timing operations based on sensed and given operating information for regulating the temperature of, and the energy delivered to the printhead assembly 116. These formulated decisions are based on printhead temperatures sensed by the sensors 140, sensed amount of power supplied and pre-programmed known optimal operating ranges, such as temperature and energy ranges, scan axis directionality errors, etc. Moreover, serial communications allows the addition of ink ejection elements 416 without the inherent need to increase leads and interconnections. This reduces the expense and the complexity of providing internal communications for the printhead assembly.

The printhead assembly of the present invention includes both complex analog and digital devices (such as microelectronic circuitry) communicating with the distributive processor. Communication between the digital and analog devices and the distributive processor allows proper control and monitoring of the processing driver head 120, 310 such as enabling tests to be performed, sensed data to be interpreted, and the processing driver head 120 to be calibrated, among other things. For instance, the distributive processor 124, 314 of the printhead assembly 116, 300 can receive stored or sensed data from other devices for controlling and regulating fire pulse characteristics, register addressing (as well as the loading of fire data into these registers), error correction of ink drop trajectory, processing driver head 120 temperature, electromagnetic interference, nozzle energy, optimal operating voltage and other electrical testing of the printhead assembly.

The distributive processor 124 may also determine the proper operating energy levels for the printhead assembly. Several components and systems within the printhead assembly have a minimum operating as well as a maximum operating temperatures and voltages, and the distributive processor helps to maintain the printhead assembly within these boundaries. Maximum operating temperatures are established assure printhead reliability and avoid print quality defects. Similarly, maximum power supply voltages are established to maximize printhead life.

One type of energy level determination is the determination of the operating voltage of the printhead assembly. Preferably, the operating voltage is determined at the time of manufacture and is encoded in the assembly memory device. However, after the printhead assembly is installed in a printing system a somewhat higher power supply 114 voltage is required in order to deliver the proper operating voltage to the printhead assembly because of additional parasitic resistance introduced by connection to the printing system. This voltage must be high enough to supply the proper voltage to the printhead assembly but be below the maximum power supply 114 voltage. Thus, it is important that the power supply voltage be adjustable in the printer.

The optimal operating voltage is determined by first finding the turn-on energy of the printhead assembly. The turn-on energy is the amount of energy that is just adequate to cause drop ejection from the nozzles of the printhead assembly. At the time manufacture the turn-on energy is determined by applying a high amount of energy and observing a drop ejection. The turn-on energy is then gradually reduced until drop ejection ceases. The turn-on energy point is that energy just above the point where drop ejection ceases. This turn-on energy together with an over-energy margin is then used to find the operating voltage and this voltage is written to the printhead assembly memory device.

In a preferred embodiment the optimal operating voltage is adjusted so as to achieve an energy level approximately 20% over the turn-on energy. This energy level is given by: ti Energy=power*time where the pulse width of the fire pulse is the measure of time. The power is given by:

$$\text{power}={}^{V}/_{r}$$

where r=resistance of the printhead assembly and V=operating voltage. In this example by setting the energy value equal to 20% greater than the Turn-on energy the optimal operating voltage may be found. For further details see U.S. patent application Ser. No. 09/253,411, filed Feb. 19, 1999, entitled "A High Performance Printing System and Protocol," which is herein incorporated by reference.

For details on methods to determine the operating energy for a print cartridge, see U.S. patent application Ser. No. 09/071,138, filed Apr. 30, 1998, entitled "Energy Control Method for an Inkjet Print Cartridge;" U.S. patent application Ser. No. 08/958,951, filed Oct. 28, 1997, entitled "Thermal Ink Jet Print Head and Printer Energy Control Apparatus and Method," U.S. Pat. No. 5,418,558, entitled "Determining the Operating Energy of a Thermal Ink Jet Printhead Using an Onboard Thermal Sense Resistor;" U.S.

Pat. No. 5,428,376, entitled "Thermal Turn-on Energy Test for an Inkjet Printer;" and U.S. Pat. No. 5,682,185 entitled "Energy Management Scheme for an Ink Jet Printer;" The foregoing commonly assigned patents and patent applications are herein incorporated by reference.

Prior to delivery and use, the printhead assembly 116 preferably undergoes a one-time factory calibration process to compensate for variations within the sections of the printhead assembly. These variations include variations between ink ejection elements 416 and internal trace and parasitic resistances. Hence, variations internal to a given printhead assembly are preferably identified and compensated for during the manufacturing process. Proper calibration ensures proper energy to the ink ejection elements 416 and extends ink ejection element life.

Specifically, the factory calibration can first determine the turn-on voltage and then calculate an operating voltage and nominal pulse width that provides sufficient over-energy. This voltage is written to the memory device of the printhead assembly. With the memory device thus programmed, the printhead assembly may be delivered to a user, either in conjunction with a printer, or as a replacement printhead assembly. At start-up or installation the calibration can be used by the printing system to determine the operating settings to be used by the printing system. In operation, the system is calibrated to set a nominal operating voltage and pulse width adequate to ensure adequate firing energy levels for full drop volume firing in "blackout conditions."

Firing an inkjet printhead continuously at high frequency and heavy duty can cause the printhead to shutdown and stop firing after a few pages depending upon the firing voltage (over-energy). The cause of the problem is due to the global substrate 410 temperature rising to 60–85 degrees C from the normal operating temperature of approximately 45 degrees C. At these substrate temperatures the local ink ejection element 416 area may be so hot (greater than 100 degrees C) that the generated bubble never collapses which stops ink drop ejection and leads to further heating and thermal runaway. Without slowing down the print speed, solutions were sought by assessing the energy requirements and controlling the energy delivered to the firing ink ejection elements 416 using dynamic pulse width adjustment.

In the past the only solutions to the thermal problems caused by the excessive heating of the printhead have been to make thin film changes to the substrate or to slow down printing. The thin film solution approach used either thinner passivation layers (Tantalum) to reduce turn-on energy or use a metallic underlayer (gold or aluminum) to take away the heat which ultimately ends up in the ink which is in contact with these layers. These approaches of making thin film changes are expensive and also reduce reliability due to ink ejection element 416 life. The present approach provides faster printing and at the same time higher reliability of printing and better ink ejection element 416 life because the over-energy to the driver head 126 is being dynamically controlled by using pulse width adjustment.

The present invention includes a thermal control system that improves stability, reliability and print quality of the printing system. The system maintains and controls the printhead assembly temperature at the desired optimum temperature by using digital feedback of the printhead temperature to the printing system. In general, the thermal control system receives a temperature from the sensor 140 of the driver head 126 and generates a digital command proportional to this sensed temperature. The thermal control system analyzes the sensed temperature and makes control decisions based on the analysis. As such, the thermal control system is able to constantly maintain the temperature of the driver head near the optimal temperature.

Generally, analog to digital converters (ADCs) and digital to analog converters (DACs) are used (not shown in FIGS. 1A and 1B). An analog temperature sensor 140 measures the temperature of the driver head 126 and the ADC converts the measurement to a digital word. The DAC receives the digitally converted signal and makes appropriate energy and temperature setting adjustments. In a preferred embodiment, the processing driver head 126 includes a temperature sensor 140 and a means to provide a digital word that correlates with the sensed temperature. This digital word is utilized by additional temperature monitoring and control circuitry that is located either on the processing driver head 120 or the printing system controller 110. An analog-to-digital converter (ADC) for converting an analog temperature input signal to a digital output signal that is proportional to the measured temperature. Next, a digital-to-analog converter (DAC) receives the digital output signal and converts the digital output signal into a substantially equivalent analog voltage signal. A decision element, such as a digital comparator, can be used to compare the analog input signal to the analog voltage signal from the DAC to determine when the digital representation of the analog signal has been reached for making control decisions based on this measured temperature. As a result, the thermal control system provides closed loop control for maintaining the processing driver head 126 at or near an optimal, programmable temperature, and for deciding if an upper limit set point has been exceeded.

Specifically, a temperature sensor 140 is located on the processing driver head 120 with a sensor voltage output proportional to a sensed temperature. The ADC converts the sensed temperature into a digital word and sends the digital word to the DAC. The DAC has a digital input and an output voltage proportional to the value of a digital word received by the digital input. The digital comparator has a first input connected to the sensor voltage output and a second input connected to the converter voltage output. The comparator generates an equivalency signal based upon the converter output voltage. The printhead may have a temperature controller 136 that compares the digital word to a preselected temperature threshold value to determine if the temperature is within a selected range.

The present invention improves processing driver head 120 performance and reliability by controlling the energy delivered to the driver head 126 in order to regulate the temperature of the driver head 126. Referring back to FIG. 1A and 1B, the distributive or data processor 124 can incorporate energy control devices 132 and thermal control devices 136 within its own circuitry, as shown in FIG. 1B. Alternatively, the controller 110 can incorporate these devices. The energy control device 132 can be used to compensate for variations in primitive supply voltage that arise due to parasitic interconnect resistance between the printer carriage and the interconnect pad 312 of the driver head 126 assembly 116. This can be accomplished by, for example, adjusting the fire pulse width to ensure constant energy delivery or to regulate the temperature of the driver head 126.

Figure 5:
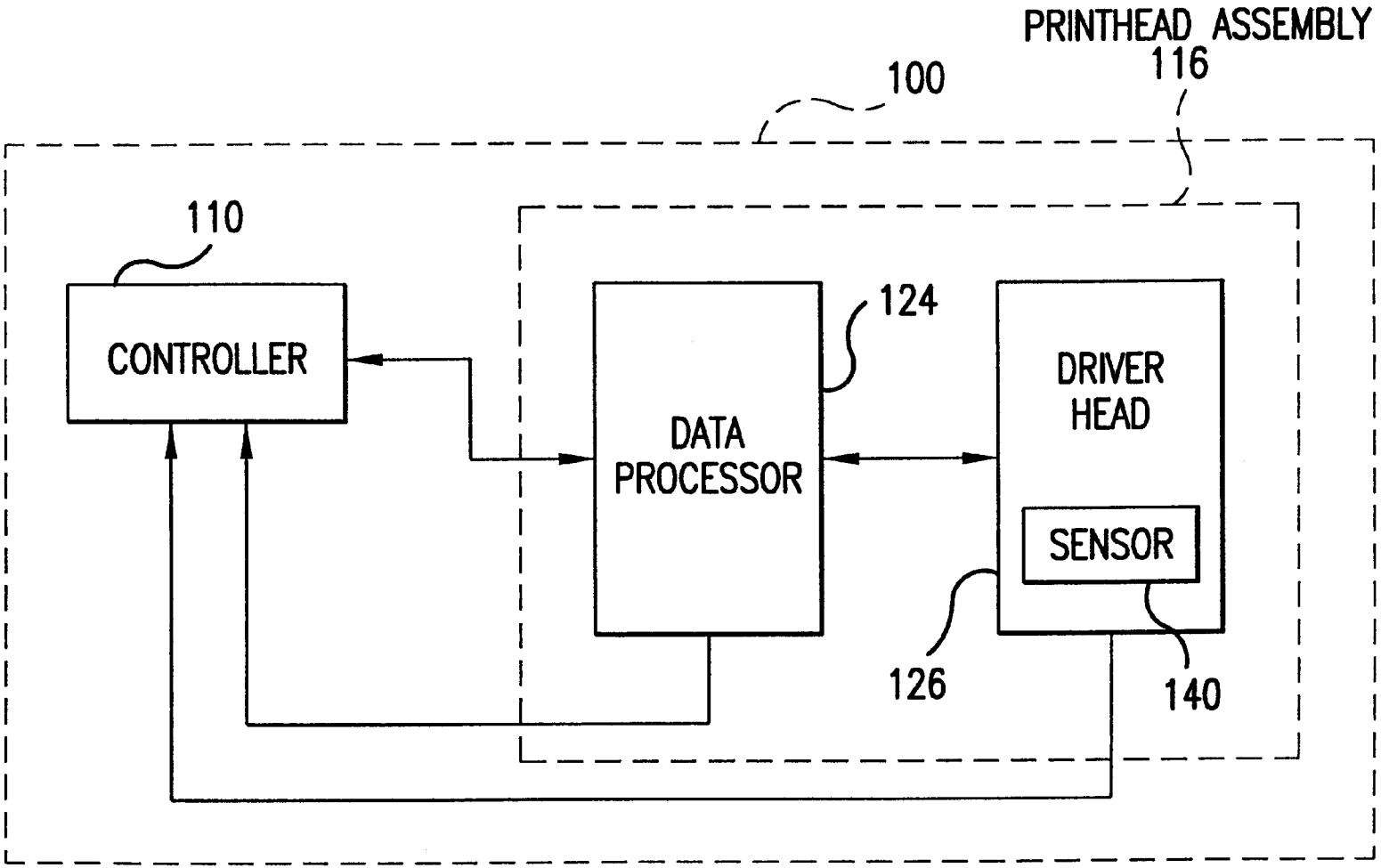
FIG. 5 is a simplified block diagram of FIG. 1 showing the dynamic pulse width control apparatus of the sent invention.

FIG. 5 is a simplified block diagram of FIG. 1 showing the dynamic pulse width control apparatus of the present invention. The printing system 100 includes a controller 110 coupled to a printhead assembly 116. The printhead assembly 116 includes a processing driver head 120 and a printhead memory device 122 (shown in FIG. 1) which can contain print cartridge calibration information. The processing driver head 120 (shown in FIG. 1) is comprised of a data processor 124, such as a distributive processor, and a driver head 126, such as an array of inkjet ink ejection elements or drop generators 416. The driver head 126 further includes sensors 140 for dynamically measuring the printhead temperature. The sensors 140 can be analog or digital sensors. Preferably the sensors 140 are distributed around the driver head so that a "global" temperature is sensed.

Although the data processor 124 can communicate with memory device 122, the data processor 124 preferably primarily communicates with the controller 110 in a bi-directional manner. The bi-directional communication enables the data processor 124 to dynamically formulate and perform its own firing and timing operations based on sensed and given operating information for regulating the temperature of, and the energy delivered to the processing driver head 120. These formulated decisions are preferably based on, among other things, sensed printhead temperatures, sensed amount of power supplied, real time tests, and preprogrammed known optimal operating ranges, such as temperature and energy ranges. As a result, the data processor 124 enables efficient operation of the processing driver head 120.

The controller 110 or distributive processor 124 can calculate an adjusted pulse width from the nominal pulse width for the print cartridge using a pulse width adjustment factor. The pulse width adjustment factor can be determined using the sensed temperature along with either an equation or a look-up table. Using the current temperature sensed, and a nominal processing driver head 126 temperature (which can be located in the printhead assembly 116 memory device 122, or the printer memory), the controller 110 or distributive processor 124 determines whether the printing operation will keep the temperature of the substrate within an acceptable temperature range. If not, then the nominal pulse width is adjusted to a suitable pulse width based on the sensed temperature.

Figure 6:
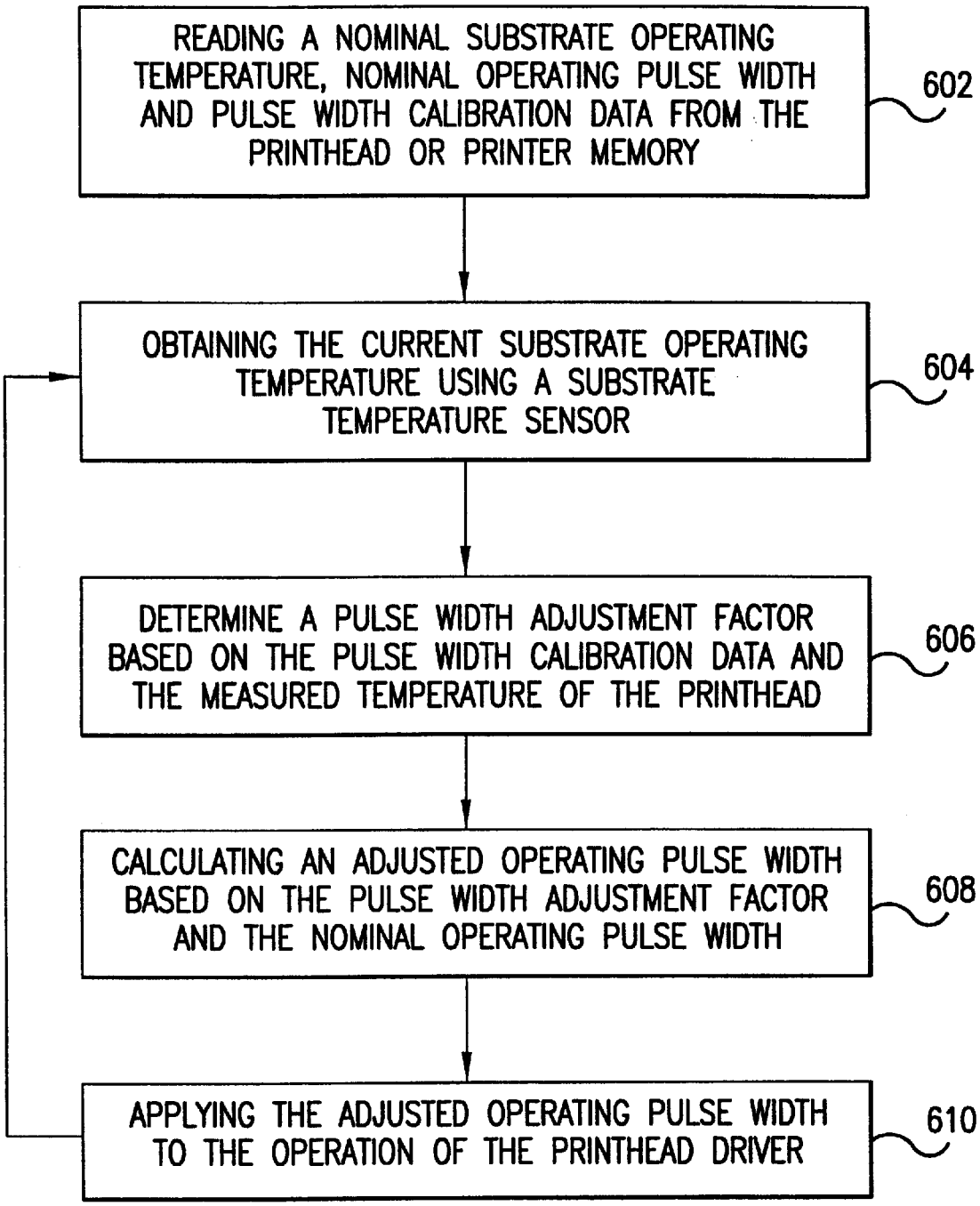
FIG. 6 is a flowchart showing procedure used by the apparatus of FIG. 5.

FIG. 6 is a flowchart showing procedure used by the apparatus of FIG. 5. In step 602, the nominal substrate operating temperature, the nominal operating pulse width and the pulse width calibration data are read from the printhead or printer memory. Step 602 is performed at start-up or when a print cartridge is replaced in the printer. In step 604, the current substrate operating temperature is read using the substrate temperature sensor. In step 606, a pulse width adjustment factor is determined based on the nominal operating temperature, the measured temperature of the printhead and the pulse width calibration data. In step 608, an adjusted operating pulse width based on the pulse width adjustment factor and the nominal operating pulse width is calculated. In step 610 the adjusted operating pulse width is applied to the operation of the printhead driver. In a preferred embodiment, steps 604 to 610 are repeated continuously during printing in order to dynamically control the pulse width. Alternatively, steps 604–610 can be performed only at the beginning of a swath. The foregoing procedure is performed simultaneously and independently for each print cartridge. Either the he controller 110 or distributive processor 124 can perform the steps 600–610.

Figure 7:
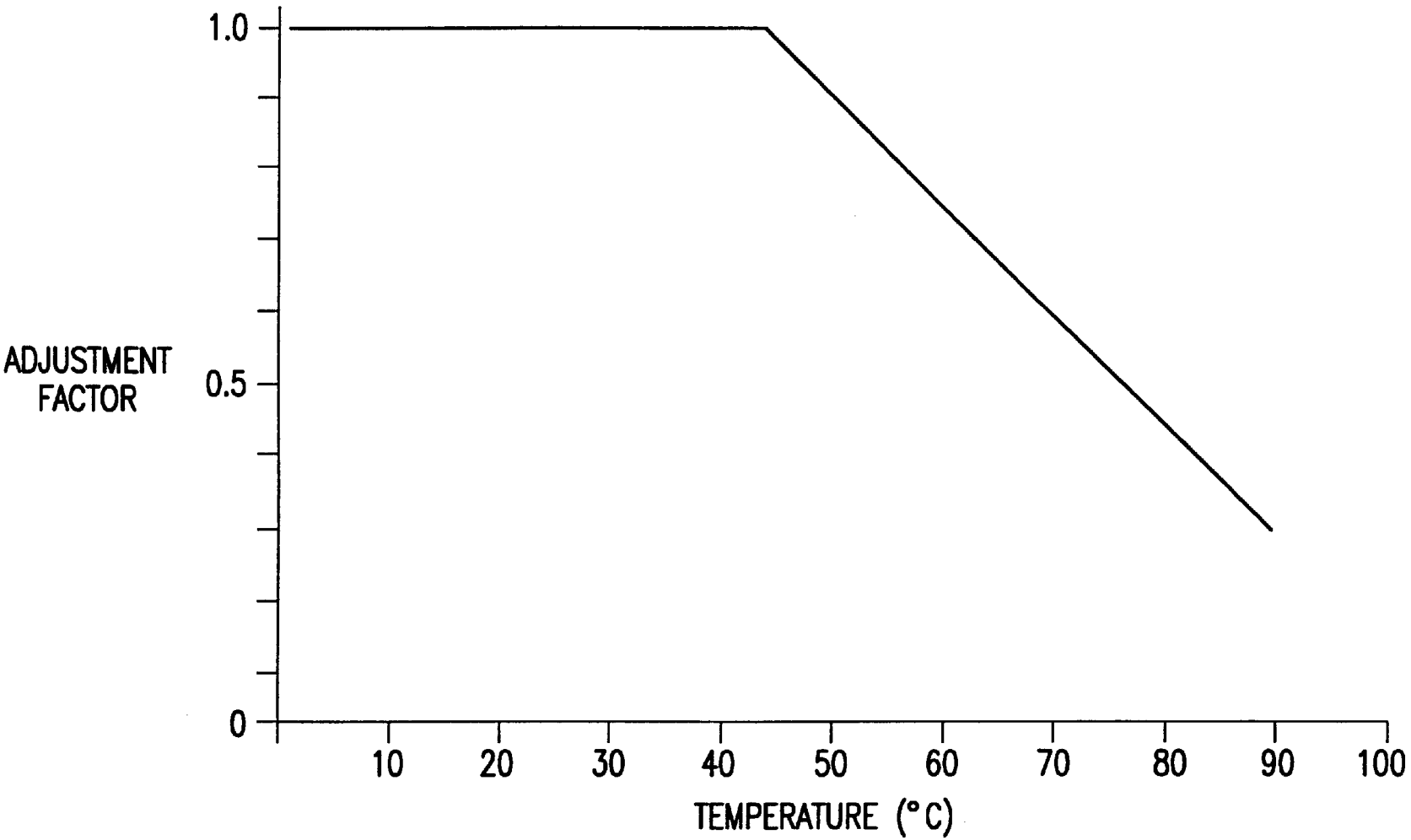
FIG. 7 is an exemplary plot showing a pulse width adjustment factor versus measured temperature.

FIG. 7 is an exemplary plot of an adjustment or calibration factor for the pulse width versus measured printhead temperature. The adjustment or calibration curve is based the thermal response model of the printhead assembly. While the adjustment curve is shown as a straight line in FIG. 5, the curve can be of any shape. The corrected pulse width is a function of nominal pulse width and the calibration factor based on the measured temperature. Based on a calibration curve or look-up table, the pulse width is adjusted using:

$$PW_{adjused}=(\text{Adjustment Factor})*PW_{nominal},$$

where PW is pulse width.

Accordingly, the present invention allows the driver head 126 to continue printing high density area fills fast, without causing any print reliability or ink ejection element reliability problems due to excessive printhead temperature. The present invention controls the pulse width to the driver head 126 at the beginning of each swath, or continuously during the swaths, in response to the printhead temperature measured by sensor 140. The turn-on energy for the ink ejection elements 416 decreases as the driver head 126 becomes hotter due to continuous printing. Therefore, pulse width is decreased as the driver head 126 heats up and the dynamic turn-on energy decreases. Likewise, the pulse width is increased as the driver head 126 cools down and the dynamic turn-on energy increases. Thus, the invention is effective in controlling the over-energy to an individual driver head 126, by providing dynamic control of the over-energy to the driver head 126 by dynamical adjusting the pulse width.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A temperature control system for an inkjet printhead assembly, comprising:

a printhead assembly having ink ejection elements energizable by an electrical pulse having an amplitude and pulse width;

a sensor coupled to the printhead assembly for generating a signal representative of the printhead temperature;

a controller which reads a nominal operating pulse width, pulse width calibration data and the signal from the sensor; said controller calculates an adjusted pulse width using the nominal operating pulse width, the pulse width calibration data and the signal from the sensor;

wherein the controller uses the adjusted pulse width to control printhead temperature.

2. The temperature control system of claim 1 wherein the controller is located on the printhead assembly.

3. The temperature control system of claim 1 wherein the controller is not located on the printhead.

4. The temperature control system of claim 1 wherein the controller reads the nominal operating pulse width and the pulse width calibration data from a memory located on the printhead assembly.

5. The temperature control system of claim 1 wherein the controller reads the nominal operating pulse width and the pulse width calibration data from a memory not located on the printhead.

6. The temperature control system of claim 1 wherein the temperature sensor is an analog temperature sensor.

7. The temperature control system of claim 6 further including an analog to digital converter for generating a digital word representing the measured analog signal.

8. The temperature control system of claim 1 wherein the temperature sensor is a digital temperature sensor.

9. The temperature control system of claim 1 wherein the temperature sensor includes multiple sensors distributed around the printhead so as to provide a global measurement of the printhead temperature.

10. The temperature control system of claim 1 wherein the pulse width calibration data is in a form of an equation.

11. The temperature control system of claim 1 wherein the pulse width calibration data is in a look-up table.

12. A method of controlling a temperature of an inkjet printhead comprising:

providing a printhead assembly having ink ejection elements energizable by an electrical pulse having an amplitude and pulse width;

reading a nominal printhead operating temperature, a nominal operating pulse width and pulse width calibration data;

obtaining a current printhead operating temperature using a sensor on the printhead;

determining a pulse width adjustment factor based on the pulse width calibration data and a measured temperature of the printhead;

calculating an adjusted operating pulse width based on the pulse width adjustment factor and the nominal operating pulse width; and applying the adjusted operating pulse width to the printhead to control the printhead temperature.

13. The method of controlling the temperature of claim 12 wherein the controller is located on the printhead.

14. The method of controlling the temperature of claim 12 wherein the controller is not located on the printhead.

15. The method of controlling the temperature of claim 12 wherein the controller reads the nominal operating pulse width and the pulse width calibration data from a memory located on the printhead assembly.

16. The method of controlling the temperature of claim 12 wherein the controller reads the nominal operating pulse width and the pulse width calibration data from a memory not located on the printhead.

17. The method of controlling the temperature of claim 12 wherein the temperature sensor is an analog temperature sensor.

18. The method of controlling the temperature of claim 17 further including an analog to digital converter for generating a digital word representing a measured analog signal.

19. The method of controlling the temperature of claim 12 wherein the temperature sensor is a digital temperature sensor.

20. The method of controlling the temperature of claim 12 wherein the temperature sensor includes multiple sensors distributed around the printhead so as to provide a global measurement of the printhead temperature.

21. The method of controlling the temperature of claim 12 wherein the pulse width calibration data is in a form of an equation.

22. The method of controlling the temperature of claim 12 wherein the pulse width calibration data is in a look-up table.

* * * * *